United States Patent [19]

Evans et al.

[11] Patent Number: 4,776,187

[45] Date of Patent: Oct. 11, 1988

[54] CHANGEABLE KEY CYLINDER EXPOSED SHACKLE PADLOCK

[75] Inventors: Walter R. Evans, Lancaster; Gregory C. Lainhart, Nicholasville, both of Ky.

[73] Assignee: Sargent & Greenleaf, Inc., Nicholasville, Ky.

[21] Appl. No.: 57,260

[22] Filed: May 27, 1987

[51] Int. Cl.[4] ..... E05B 67/22

[52] U.S. Cl. ..... 70/38 A; 70/52; 70/369

[58] Field of Search ..... 70/369, 367, 52, 38 R, 70/38 A, 38 B, 38 C

[56] References Cited

U.S. PATENT DOCUMENTS

| | | | |
|---|---|---|---|
| Re. 29,643 | 5/1978 | Berry et al. . | |
| 2,457,650 | 12/1940 | Dyson | 70/369 |
| 3,710,603 | 1/1973 | Miller | 70/38 A |
| 3,713,309 | 1/1973 | Miller | 70/38 A |
| 3,785,182 | 1/1974 | Van Lahr | 70/38 B |
| 3,882,699 | 5/1975 | Flack et al. . | |
| 4,241,594 | 12/1980 | Miller | 70/38 A |

*Primary Examiner*—Robert L. Wolfe

*Attorney, Agent, or Firm*—Mason, Fenwick & Lawrence

[57] ABSTRACT

A changeable key cylinder padlock including a padlock casing, a shackle moveable between a lower locking position and a upper release position, the casing having a central substantially cylindrical cavity therein located between the sockets shaped to receive and removably house a key lock cylinder. The lock cylinder located in the plug cavity has a first key position and is operable by a operator key and control key to rotate to second and third key positions respectively. Locking spheres are positioned when the lock cylinder occupies the first key position to hold the shackle in the lower locking position and release the shackle at the second and third key positions for movement to said upper release position. An interlock plunger and pin are intercoupled with the lock plug normally occupying a first interlock position allowing key rotation of the cylinder member to and between the key positions and movable when the cylinder member occupies the second key position and the shackle is moved to said release position to assume a second interlock position restraining the cylinder member against return movement to the first key position to restrain the key against removal from the lock cylinder.

15 Claims, 4 Drawing Sheets

FIG-1
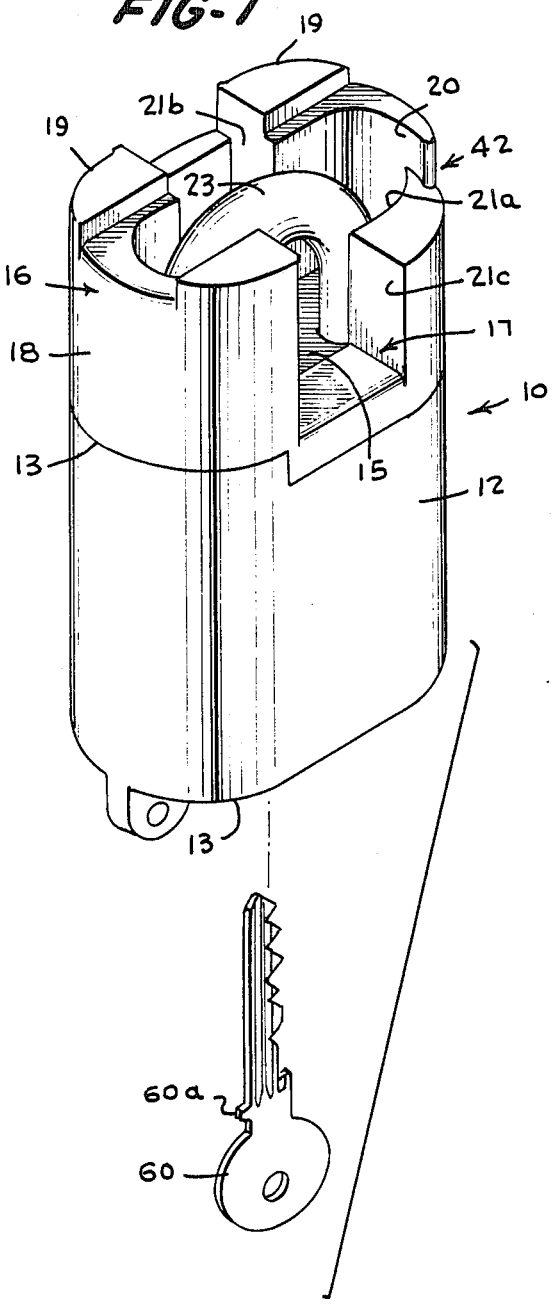
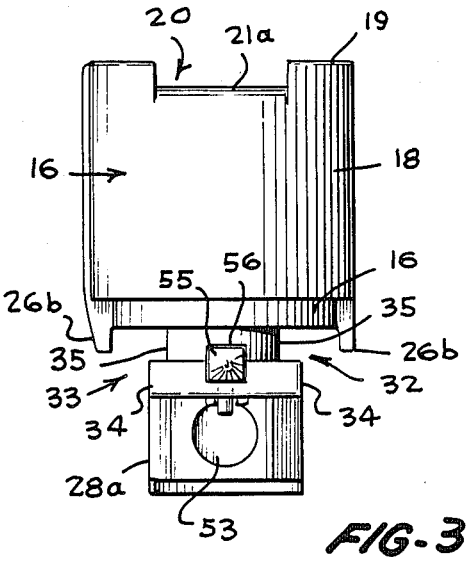
FIG-3
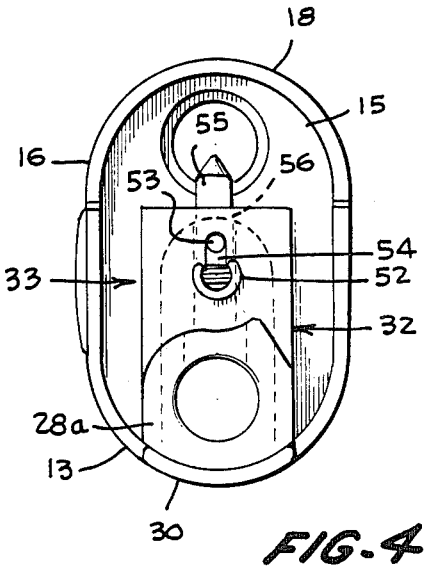
FIG-4

FIG-5
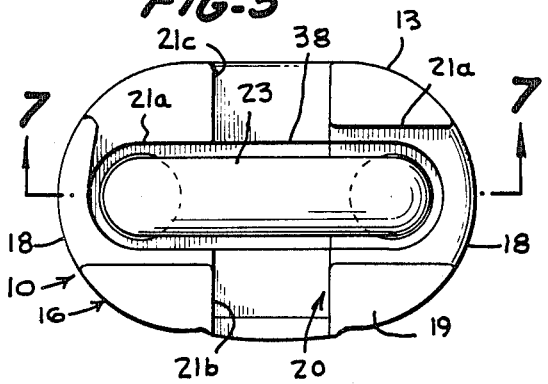
FIG-6
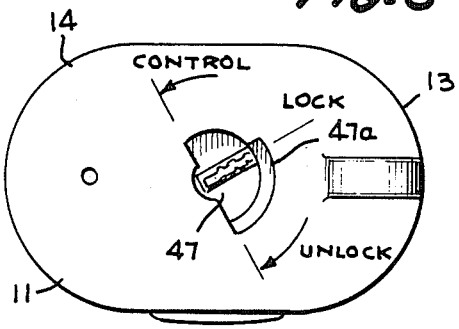
FIG-7
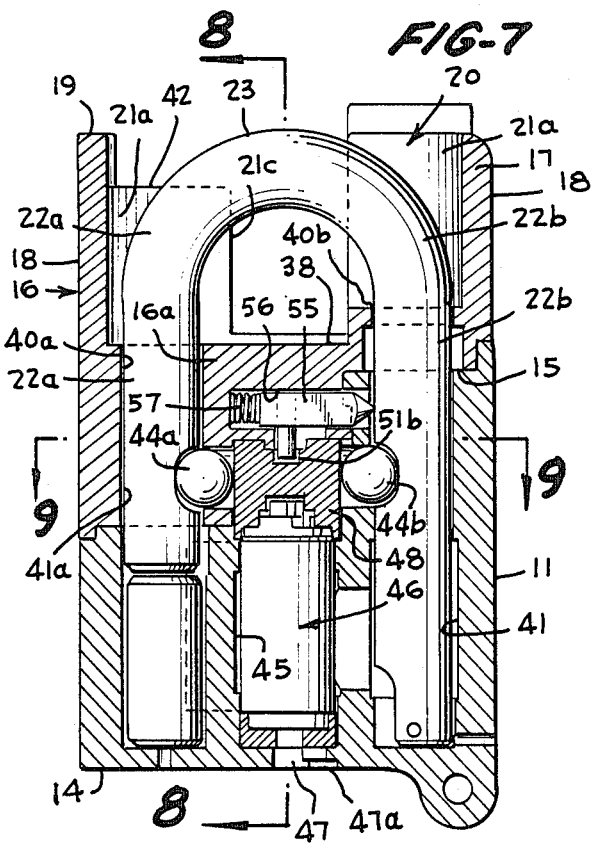
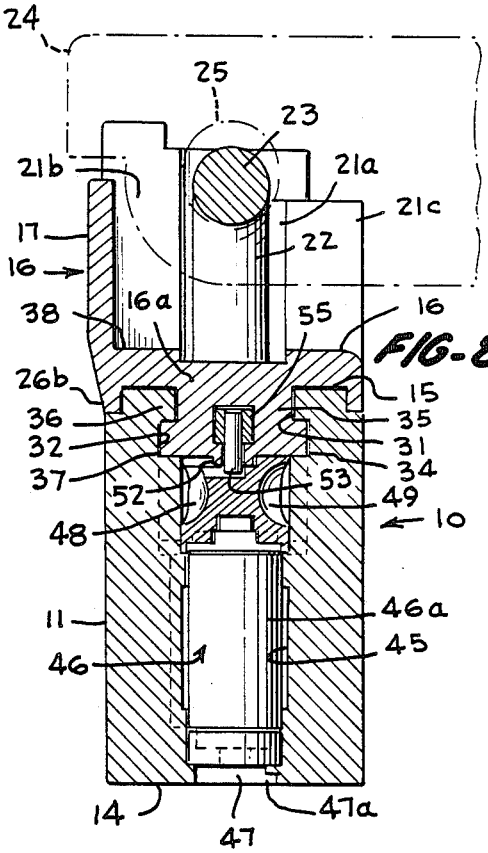
FIG-8
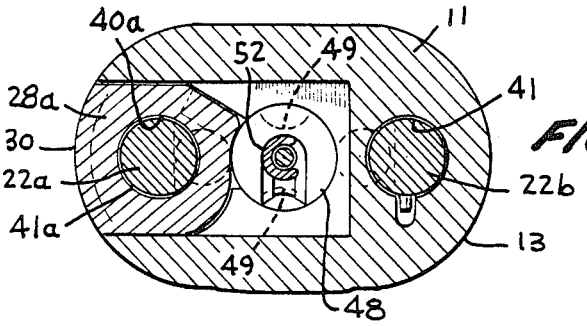
FIG-9

FIG-10
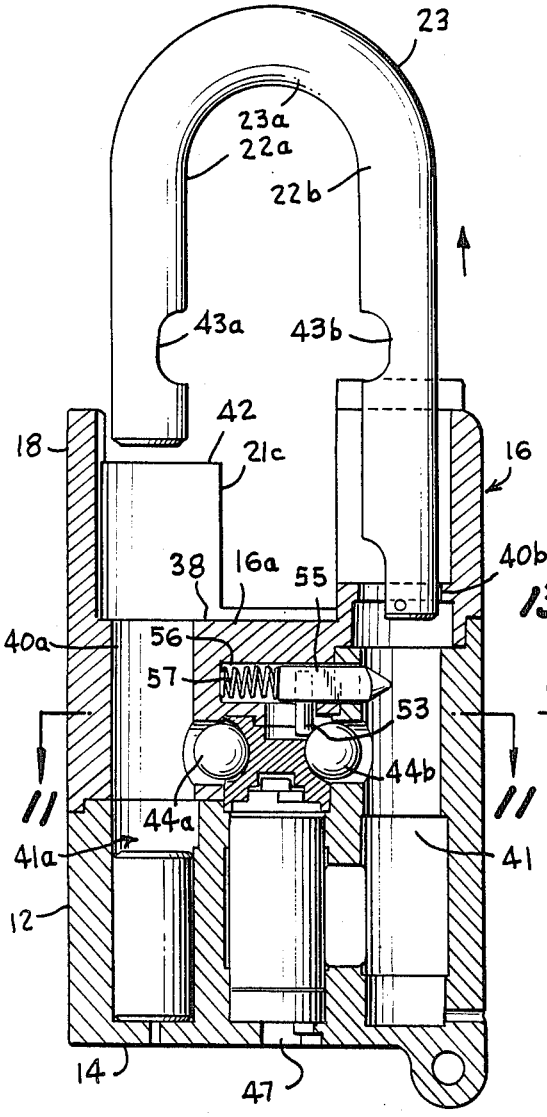
FIG-12
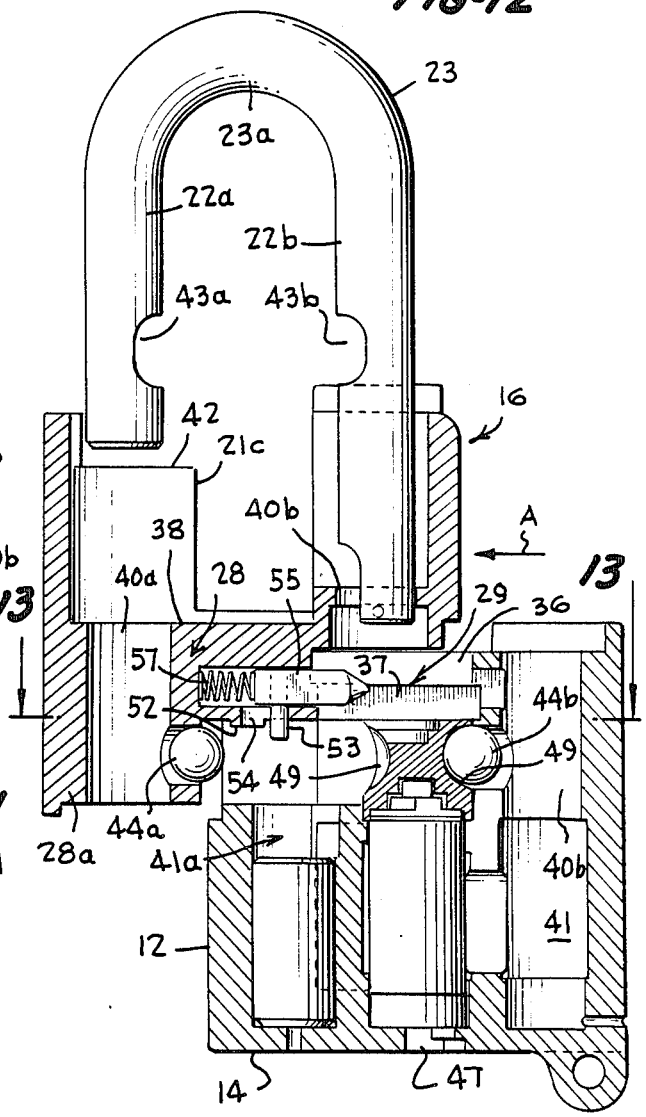
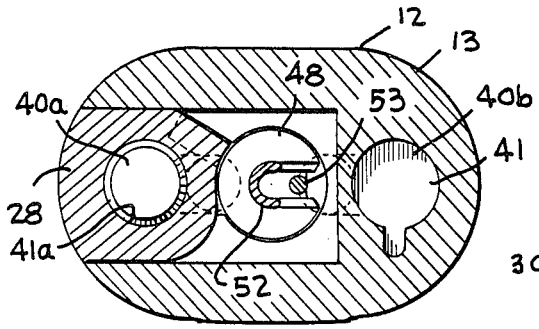
FIG-11
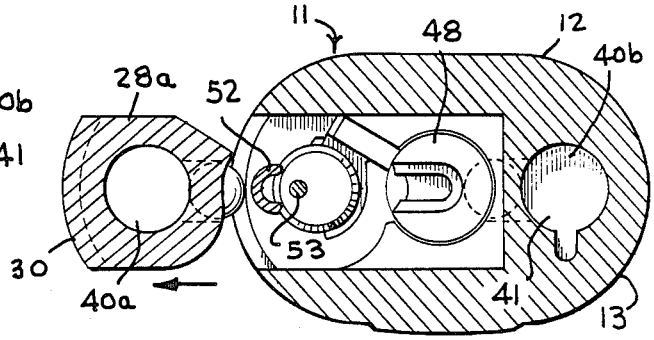
FIG-13

CHANGEABLE KEY CYLINDER EXPOSED SHACKLE PADLOCK

BACKGROUND AND OBJECTS OF THE INVENTION

The present invention relates in general to changeable cylinder, key operable padlocks, and more particularly to changeable padlocks of the exposed shackle type, having key a lock plugs and a movable cover for normally closing the cavity housing the key lock cylinder, permitting replacement of the key lock cylinder under certain conditions to adapt the padlock for use with a different key.

Heretofore most key operated padlocks have ordinarily been constructed in such manner that the key lock mechanism, commonly referred to either as a cylinder or a plug, is incorporated in the padlock body during manufacture so that it cannot be replaced without substantial destruction of the lock. However, it has been recognized that it is desirably in many instances, particularly in connection with high security padlocks adapted for warehouse or storage enclosures where constant security supervision is impractical or difficult, to provide for removal of the key lock cylinder or plug (the lock cylinder being hereinafter frequently referred to as a "lock plug") in some manner so that a key plug designed for another key can be substituted to permit operation of the lock by a different key. Two basic types of changeable plug padlocks which have evolved are the bottom loading type, where a bottom plate serves as the removable cover for the plug cavity, and the top loading type, where a removable cover of some type is provided at the top of the padlock body. In the bottom loading type, such locks have been constructed so as to permit removal of the key lock plug either by use of a special change key, or by rotation of one or a pair of retaining screws accessible in the lower part of the socket or sockets for the padlock shackle legs, thus permitting change only when the lock is unlocked, or by retraction of a member accessible through one of the shackle leg sockets only when the associated shackle leg is withdrawn, to release the bottom cover plate. In such cases, the cover plate for the cylinder or plug cavity has been a bottom plate on the padlock body which is retained in position by some type of securing means which is operably only from the interior of the padlock body, but the presence of such a separate plate fixed in the padlock body provides for possibilities of removal of the bottom loading cover by wedges or similar attack tools. However, most previously available padlocks of the above described construction do not have sufficient resistance to attack to meet the requirements of high security lock applications, especially for protection of remote or intermittently supervised security closure.

More recently, high security key operable padlocks of the top loading type have been developed with removable top cover mechanisms for permitting changing of the key lock plug, as disclosed in U.S. Pats. Nos. 3,710,603 and 3,713,309, but it is desired to improve the operation of such padlocks for high security applications and provide locking mechanisms cooperative with the shackle legs to effectively resist strong shackle retracting forces.

An object of the present invention, therefore, is the provision of an improved key operable padlock construction wherein the key lock plug is protected from removal from a cavity therefor in the padlock body by a moveable cover which may be displaced relative to the padlock case when activated by a key and the shackle has been withdrawn to release position, and wherein the key cannot be removed when the shackle is in a release or unlocking position.

Another object of the present invention is the provision of a novel key operable padlock wherein a slide type cover is normally held against movement from a protective position over the cavity housing the key lock plug by one of the legs of the padlock shackle and which is released for removal to a position permitting access to the key lock plug and its housing cavity for substitution of a different key lock plug when a special control key has been positioned in a predetermined way and the shackle has been withdrawn to unlocking position.

Another object of the present invention is the provision of a novel changeable key cylinder operable padlock wherein a slide type cover for the key cylinder housing cavity is integrated with an upper portion of the padlock body and an integral shroud formation shielding the padlock shackle against access when in closed condition, wherein such slide and intergrated padlock body and shroud portions are removable when the key cylinder is control key operated to a change position, permitting substitution of another key cylinder or substitution of a different upper padlock enshroud configuration for the upper portion of the padlock.

In many uses of padlocks, the padlock is in an exposed position in remote, not continuously supervised, locations where a person seeking unauthorized entry into the space secured by the padlock may attempt to attack the padlock with attack tools such as wedges, sledge hammers, carbide tip saws, and other sophisticated devices to destroy the security of the lock. A further object of the present invention, therefore, is the provision of a novel key operable padlock construction for improving the security of padlocks designed to secure remote storage facilities and the like enhance their resistance against efforts to gain unauthorized entry, wherein the locking mechanism for restraining the shackle within the padlock body and the slide cover for the cavity housing the key lock plug afford strong resistance to attack.

A further object of the present invention is the provision of novel structure for a key operable padlock construction of the type described in the two immediately preceding paragraphs, wherein means are provided to selectively prevent removal of the operator key from the padlock when the shackle is in the open position.

Other objects, advantages and capabilities of the present invention will become apparent from the following detailed description taked in conjunction with the accompanying drawings illustrating preferred embodiments of the invention.

BRIEF DESCRIPTION OF THE FIGURE

FIG. 1 is a perspective view of an exposed shackle padlock having a slidable cover portion integrated with an upper padlock body top wall portion and a shroud formation joined thereto, forming an upper body section protecting the key lock plug cavity and shielding the padlock shackle against access, embodying the present invention;

FIG. 3 is an end elevation view of the upper body section, viewed from the right of FIG. 7;

FIG. 4 is a bottom plan view of the lower body section;

FIG. 5 is a top plan view of the padlock;

FIG. 6 is a bottom view thereof with legends indicating the lock, unlock, and central key positions therefor.

FIG. 7 is a vertical section view thereof taken along the line 7—7 of FIG. 5 in the principal plane of the shackle with the shackle in locking position;

FIG. 8 is a vertical section view thereof taken along the line 8—8 of FIG. 7 perpendicular to the section plane of FIG. 7;

FIG. 9 is a horizontal section view taken along the line 9—9 of FIG. 7; .

FIG. 10 is a vertical section view similar to FIG. 7, showing the shackle in withdrawn unlocking position;

FIG. 11 is a horizontal section view taken along the line 11—11 of FIG. 10;

FIG. 12 is a vertical section view similar to FIG. 10, showing the upper body section displaced laterally to a position allowing its release from the lower body section; and FIG. 13 is a horizontal section view taken along the line 13—13 of FIG. 12.

DETAILED DESCRIPTION OF PREFERRED EMBODIMENTS

Figure 2:
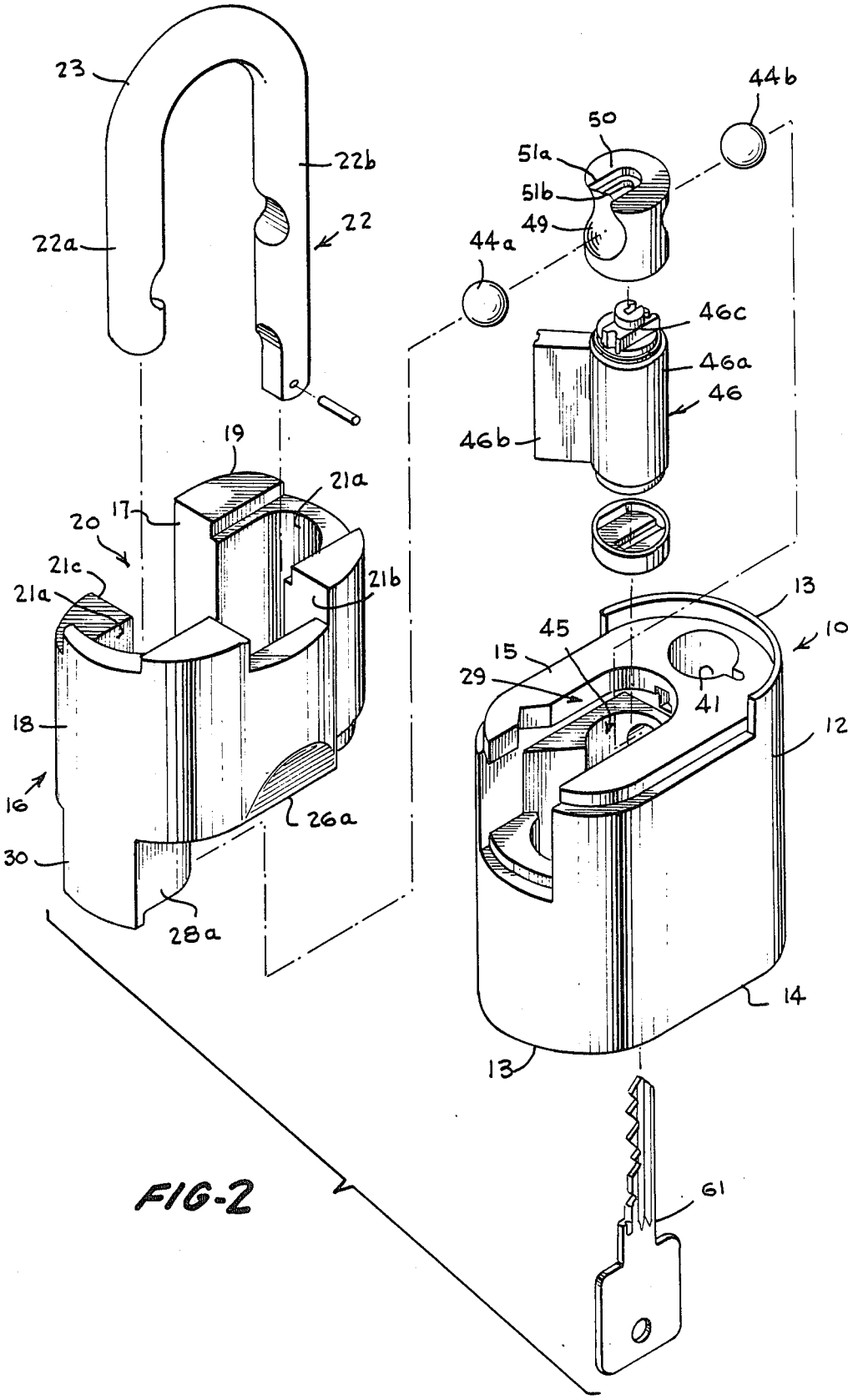
FIG. 2 is an exploded perspective view thereof.

Referring to the drawings, wherein like reference characters designate corresponding parts throughout the several figures, there is illustrated in FIGS. 1-13, a high security shrouded type changeable key cylinder padlock embodying the present invention, indicated generally by the reference character 10 in the embodiment illustrated in these Figures, the padlock comprises a padlock body 11 formed in two sections. A main or lower padlock body section of generally eliptical configuration in cross-section, indicated at 12, formed preferably as a unitary casted body of a highly resistant material such as hardened steel, providing a generally rounded lateral surface 13 forming the front and rear side wall portions and the end wall portions of the lower main body section 12, extending between a flat bottom wall 14 and a top surface 15 of the lower section 12. Surmounted over this lower or main padlock body section 12 in normal use is an upper body section 16 providing a bottom wall portion **16*a* forming a cover member overlying the lower body section 12 and having a shroud portion 17 of generally eliptical cross-section providing a rounded outer surface 18 conforming substantially to and representing an upward extension of the lateral surface 13 of the main or lower body section 12. The rounded lateral surface 18 terminates in a stepped top wall 19 which is interrupted by a cross-shaped or cruciform recess 20 having arms 21*a* in a first plane defining recess portions for receiving legs 22 of the generally U-shaped padlock shackle 23, and also having recess arms 21*b*, 21*c* in a second plane perpendicular to the first plane, with one of the arms 21*c* opening rearwardly through the shroud portion 17 to define a recess for snuggly accommodating hasp portions of locking hasps 24 whch project into the portion 21*c* of the recess to permit the shackle 23 to extend through the apertures 25 of a hasp portion 24**.

The downwardly facing bottom wall portion 16 of the upper shroud and top wall forming body section 16 of the padlock body includes two laterally flanking surface portions **26*a*, 26*b* to abut and conform substantially to corresponding portions of the top wall 15 of the lower or main padlock body section 12, and also includes an integral downwardly extending slide formation 28 to compliment and slidably interfit with and track in ribs and channels or tongues and grooves in the recess 29 for the slide formation 28 opening through the upper wall 15 of the lower main padlock section 12 and also opening laterally through the rounded lateral surface 13 thereof. As is more clearly shown in FIG. 2, the slide formation 28 includes a depending foot portion 28*a* having a convex outer end 30 to register with an form, in effect, a continuation of the upwardly and downwardly adjacent rounded lateral surface portions 18 and 13 of the upper section 16 and lower body section 12 respectively. Each of the sides 31, 32 of the slide formation 28 and the inner end 33 thereof have a plurality of alternating ribs and channels, or tongues and grooves, indicated at 34 and 35, to compliment and slidably interfit with an track in ribs and channels, or tongues and grooves, indicated at 36, 37 in the upper portion of the main body section 12 designed to slidably receive the slide formation 28. The upper surface 38 of the slide formation lies in a plane perpendicular to the axis of the shackle legs 22 and forms, in effect, the bottom surface of the cruciform cavity or recess 20 near the lower end of the shroud portion 17, together with surfaces lying in the same plane as the surface 38 but extending toward the opposite rounded ends of the padlock body. This upper surface 38 and an upwardly stepped extension thereof have circular openings 40*a*, 40*b*, for the shackle legs 22*a*, 22*b***, respectively.

The shackle 23 is preferably in the form of a U-shaped rod of hardened steel or is formed with saw tooth resisting or destroying portions in accordance with the teaching of Schwader U.S. Pat. No. 4,064,716, having a longer leg and a shorter leg, the longer leg being indicated at **22*b* and the shorter leg at 22*a*. The longer leg 22*b* passes through the circular opening 40*b* therefor into the socket 41 in the lower padlock body section 12 which extends a substantial distance within the padlock body toward the bottom surface 14 thereof. The longer shackle leg 22*b* is permitted a selected amount of axial and rotatable movement relative to the padlock body 11, but is normally restrained against complete withdrawal from the socket by means of a pin or similar formation of the type known in the art forming an abutment stop or projection for preventing complete withdrawal of the shackle from the upper shroud section 16 of the padlock body. This projection engages a stop shoulder provided in the portion of the socket 41 for the longer shackle leg 22*b* in the lower portion of the upper shroud section 16** of the padlock body.

The free end portion of the shorter shackle leg **22*a* enters through the circular entrance opening 40*a* in the upper surface 38 of the slide formation portion 28 and extends into the closed lower socket 41*a* in the main padlock body section 12 provided therefor and communicating with the entrance opening 40*a* when the shackle is in the downwardly extended or locked position shown in FIG. 1. By this construction, the shorter leg 22*a* of the shackle can be withdrawn from the padlock body when the padlock is unlocked, by axially withdrawing the longer leg 22*b* of the shackle to its retracted or withdrawn limit position shown in FIG. 10, wherein the lower end portion of the shorter shackle leg 22*a* registers with and can pass through the clearance cut off 42 in the shroud portion 17, whereupon the shackle can then be rotated about the axis of the longer leg 22*b*. The U-shaped shackle includes the usual curved intermediate portion 23*a* extending between the shackle legs 22a, 22b and which serves as the portion which engages the apertured hasp members 24 whose apertures 25 closely approximate the diameter of the shackle and are adapted to register with each other and receive the shackle in the locked condition. The shackle legs 22a and 22b also have a notch 43a, 43b located within the padlock body when the shackle is in the locking position and which are disposed in the confronting or inwardly facing portions of the shackle legs to receive spherical locking balls 44a, 44b. In this retracted locked position of the shackle, the curved portion 23a is securely nested in the cruciform recess with its uppermost surface portions lying substantially flush with the top surface 19 of the shrouded portion 17**.

The padlock body includes a closed-bottom lower central bore portion forming a key cylinder housing cavity 45 which is shaped in size to snuggly accommodate a key lock plug 46 of conventional construction, for example of the type having a cylindrical main body portion 46a and a tumbler pin housing tower 46b, including a bolt formation 46c resembling a diametric rib at the upper end of the rotatable cylinder therein. The key cylinder plug 46 also includes a key opening in the downwardly facing end portion of the rotatable cylinder portion thereof located immediately above a key access opening 47 in the bottom surface 14 of the lower padlock body section 12. Surmounted over the key cylinder plug 46 as a separate member is a generally cylindrical adaptor member 48 having a recess in the lower end portion thereof to interfit with and receive the bolt formation 46c of the key cylinder plug 46 to be rotated when the proper key rotates the key cylinder. The adaptor member 48 includes a pair of oppositely facing diametric concave cavities 49 to be rotated into registery with and receive the locking balls 44a, 44b when the cylinders operated by the proper key, accommodating convergent movement of the locking balls 44a, 44b toward each other to release the shackle 23 for axial withdrawal movement. The portions of the adaptor member 48 forming the cylindric wall portions thereof extending between the concave cavities 49 are brought into registery with the locking spheres 44a, 44b when the key operated cylinder 46 and the adaptor cam member 48 are rotated to the locking position, forcing the locking spheres 44a, 44b away from each other and into the notches 43a, 43b in the shackle legs.

Referring now to particularly to FIGS. 2, 4, 6, 7, and 9–13, it will be seen that the upper end surface of the adaptor cam member 48 includes a stepped U-shaped radial recess 50 extending from the center of the circular upper surface of the adaptor cam member 48 through one edge thereof aligned with one of the concave cavities 49 for one of the locking spheres 44a, 44b. This U-shaped radial control recess includes a wider upper portion 51a of the width to receive an interrupted circular boss formation 52 depending from the central portion of the slide formation 28 at the bottom of the upper body section 16 and includes a narrower lower recess portion 51b of the width to slidably accommodate the pin 53 which depends through a slot 54 in the slide formation 28 from a plunger member 55. The plunger 55 is of rectangular cross-section as will be apparent from FIGS. 3 and 8, and is slidably movable in a recess 56 therefor in the slide formation 28 and is resiliently biased outwardly by coil spring 57 in the recess 56 into the socket 41 for the longer shackle leg 22b. In the illustrated embodiment, a pointed contact end is provided on the end of the slide plunger 55 nearest the shackle leg 22b to be engaged by the shackle leg 22b in the retracted downward position of the shackle 23, as shown in FIGS. 7, positioning the pin 53 in the centered position registering with the axis of the cylindrical adaptor cam member 48 when the latter is in the locked position shown in FIG. 9.

In the normal operation of the padlock by the operator's key, for example as shown at 60 in FIG. 1, the key is inserted through the access opening 47 in the bottom wall 14 of the padlock body in the angular position shown in FIG. 6, wherein the legend "LOCK" is provided to indicate this position, and may be rotated through approximately 90° in a clockwise direction, as viewed in FIG. 6, to the position designated by the legend "UNLOCK". The operator's key 60 is limited to this 90° range of movement between the "LOCK" and "UNLOCK" positions by the lug formation 60a as shown on the key in FIG. 1, which is accommodated in the arcuate 90° shallow curve or enlargement recess portion 47a of the key access opening 47. Such clockwise rotation of the operators key 60 effects corresponding rotation of the adaptor cam member 48 through 90° about its center axis registering with the center axis of the pin 53, and bringing its concave cavities 49 into registry with the locking spheres 44a, 44b which will accommodate sufficient convergent movement of the locking spheres toward each other to permit retraction or withdrawal of the shackle 23 to the unlocked position of FIG. 10. During this 90° movement of the adaptor cam member 48, the radial U-shaped recess 50 of the adaptor cam member 48 shifts through 90° to the position illustrated in FIG. 11 where it opens toward the socket 41 for the longer shackle leg 22b. Thus, upon retraction of the shackle leg to the raised unlocked position of FIG. 10, the shackle is withdrawn from contact with the pointed end of the plunger 55 and the plunger spring 57 urges the plunger to the projected position of FIG. 10, carrying with it the pin 53 which moves through the narrower radial recess portion 51b to an off-center position relative to the center axis of the adaptor cam member 48. With the plunger 55 and its pin 53 thus projected to the off-center position out of registry with the center axis of rotation of the adaptor cam member 48, it is then impossible to rotate the operator's key 60 back to the "LOCK" position which it must assume in order to permit withdrawal of the key. Therefore, the interaction of the pin on the plunger with the top of the adaptor cam 48 ensures retention of the operators key 60 in the padlock body while the padlock is in the unlocked position.

A control key, as indicated at 61 in FIG. 2, is also provided, which does not have the tab 61a projecting therefrom, and which can therefore be rotated in a counterclockwise direction, as viewed in FIG. 6 from the "LOCK" position to the "CONTROL" position. Such counterclockwise rotation of the control key 61 and the bolt formation of the key cylinder, effects corresponding rotation of the adaptor cam member 48 to the position illustrated in FIG. 13, wherein the radial portions 51a and 51b of the recess 50 move angularly through 90° to a position opening toward the shackle leg opening 40a of the socket 41a, while the pin 53 remains centered relative to the axis of rotation of the adaptor cam member 48. At this position, the concave cavities 49 in the adaptor cam member 48 movein to confronting registry with the locking spheres 44a, 44b to accommodate convergent movement of the locking spheres, releasing the shackle 23 to be withdrawn to the opened position of FIGS. 10, 12. The plunger 55 does not move in response to the force of its spring 57 because its pin 53 is held in centered position relative to the axis of rotation of the adaptor cam member 48 by the curved bottom wall of the radial recess portion 51*b*. With the control key 61, in the "CONTROL" position and the shackle 23 withdrawn to the opened or unlocking position of FIG. 10, the upper body portion 16 can be shifted endwise as permitted by the surfaces of the tongue and groove formations 34–37 to displace the shackle and associated upper padlock body 16 leftwardly as viewed in FIG. 12 through the position shown in FIG. 12 and to a completely decoupled condition exposing the adaptor cam member 48, the locking spheres 44*a*, and 44*b*, and the lock cylinder 46 to be removed by inverting the lower padlock body section 12 and permitting them to drop out of their housing cavities. Since the radial recess 50 in the top of the adaptor cam member 48 is opening toward the socket for the shorter shackle leg 22*a*, it will be seen, by consideration of FIG. 13, that the pin 53 is free to be completely withdrawn from the radial recess portion 51*b* during the decoupling movement of the shackle and upper padlock body section 16 in from the lower padlock body section 12. Upon replacing the key lock cylinder with a new key lock cylinder 46 in the cavity 45 and placing the locking spheres 44*a* and 44*b* in their appropriate cavities, and inserting the adaptor cam member 48, the shackle and upper padlock body section 16 can be reassembled with the lower padlock body section 12 by aligning the interfitting tongue and groove formation 34–37 and sliding the upper padlock body section 16 in the direction opposite the arrow A in FIG. 12 to the aligned condition shown in FIG. 10. The control key 61 for the key lock cylinder will, of course, need to be inserted through the key access opening 47 and rotated to the "CONTROL" position to align the concave recesses 49 with the locking spheres 44*a*, 44*b* in order to condition the lock for return of the shackle to the lowered or locked position of FIG. 7.

We claim:

1. A changeable lock cylinder padlock of the key-operable type comprising a padlock casing having a bottom wall portion and a pair of laterally spaced sockets opening upwardly therethrough adjacent opposite ends of the casing for receiving legs of a shackle and accommodating axial reciprocating movement of the shackle between a lower locking position and a upper release position, a shackle having parallel legs including a longer shackle leg and a shorter shackle leg, the casing having a central substantially cylindrical lock cylinder cavity therein located between said sockets shaped to receive and removably house a key-operable lock cylinder, a key-operable lock cylinder removably received in said cavity having a rotatable cylinder member and a key passage adjacent to said bottom wall portion for insertion of a key into the cylinder member through an opening in said bottom wall portion, said cylinder member having a first key position and operable by an operator key and control key to rotate to second and third key positions respectively, means responsive to positioning of said lock cylinder at said first key position for holding said shackle in said lower locking position and responsive to positioning of the cylinder member at said second and third key positions releasing said shackle for movement to said upper release position, interlock means intercoupled with said lock cylinder normally occupying a first interlock position allowing cylinder member rotation to and between said key positions and movable when the cylinder member occupies said second key positions and the shackle is moved to said release position to assume a second interlock position restraining the cylinder member against return movement to said first key position, and key restraint means barring removal of an operator's key in the lock cylinder from the lock cylinder when the cylinder member is displaced from said first key position toward said second or third key positions, said cylinder member having an axis of rotation paralleling said legs, and said interlock means including a pin disposed in registry with said axis of rotation at said first interlock position and displaced to an eccentric position relative to said axis at said second interlock position, the pin when disposed in said eccentric position preventing return rotation of the lock cylinder to said first key position.

2. An changeable key cylinder padlock as defined in claim 1, wherein said pin is supported for rectilinear reciprocative movement along an axis extending between and disposed perpendicular to center axes of said shackle legs.

3. A changeable key cylinder padlock as defined in claim 2, wherein said pin is supported by and depends from a rectilinearly movable slide plunger urged to project into the socket for one of said shackle legs when the shackle is in said upper release position and being engaged by such one shackle leg to slidably move said plunger to a position disposing said pin at said first interlock position when the shackle occupies said lower locking position.

4. A changeable key cylinder padlock as defined in claim 1, including slot means receiving said pin and positioned at selected angular positions by said cylinder member for receiving said pin therein and accommodating movement of said pin from said first interlock position to said second interlock position when said lock cylinder occupies said second key position.

5. A changeable key cylinder padlock as defined in claim 2, including slot means receiving said pin and positioned at selected angular positions by said cylinder member for receiving said pin therein and accommodating movement of said pin from said first interlock position to said second interlock position when said lock cylinder occupies said second key position.

6. A changeable key cylinder padlock as defined in claim 3 including slot means receiving said pin and positioned at selected angular positions by said cylinder member for receiving said pin therein and accommodating movement of said pin from said first interlock position to said second interlock position when said lock cylinder occupies said second key position.

7. A changeable key cylinder padlock as defined in claim 1, including a rotatable, generally cylinder adaptor cam rotatably supported in said cavity and intercoupled with said cylinder member for rotation therewith, said adaptor cam having relieved portions disposed to accommodate shackle releasing movement of the means for holding and releasing the shackle at said second and third key position, and said adaptor cam having shoulder formations positioned to receive said interlock means at said first interlock position and allow movement of the interlock means to said second interlock position when the lock cylinder occupies said second key position.

8. A changeable key cylinder padlock as defined in claim 7, wherein said pin is supported for rectilinearly reciprocative movement along an axis extending between and disposed perpendicular to the center axes of said shackle legs.

9. A changeable key cylinder padlock as defined in claim 7, wherein said adaptor cam is of generally cylindrical configuration having a radial slot in its uppermost surface defining said shoulder formations, said radial slot being disposed at selected angular positions by said cylinder member for receiving said pin therein and accommodating movement of said pin from said first interlock position to said second interlock position when said lock cylinder occupies said second key position.

10. A changeable key cylinder padlock as defined in claim 9, wherein said cylinder member has an axis of rotation paralleling said shackle legs, and said pin of said interlock means is disposed in registry with the axis of rotation of the cylindrical adaptor cam at said first interlock position and displaced by movement through said slot to an eccentric position relative to said axis of rotation at said second interlock posiion, said pin when disposed at said eccentric position preventing return movement of the lock cylinder to said first key position.

11. A changeable key cylinder padlock as defined in claim 1, wherein said bottom wall portion of said padlock casing adjacent said key passage for said cavity has means for accommodating rotation of a control key in the key passage from said first key position to either said second interlock position or said third interlock position, and shoulder means positioned to allow movement of the operator's key from said first key position to said second key position but barring movement of the operator's key from said first key position to said third key position.

12. A changeable key cylinder padlock as defined in claim 2, wherein said bottom wall portion of said padlock casing adjacent said key passage for said cavity has means for accommodating rotation of a control key in the key passage from said first key position to either said second interlock position or said third interlock position, and shoulder means positioned to allow movement of the operator's key from said first key position to said second key position but barring movement of the operator's key from said first key position to said third key position.

13. A changeable key cylinder padlock as defined in claim 12, wherein said bottom wall portion of said padlock casing adjacent said key passage for said cavity has means for accommodating rotation of a control key in the key passage from said first key position to either said second interlock position or said third interlock position, and shoulder means positioned to allow movement of the operator's key from said first key position to said second key position but barring movement of the operator's key from said first key position to said third key position.

14. A changeable key cylinder padlock as defined in claim 7, wherein said bottom wall portion of said padlock casing adjacent said key passage for said cavity has means for accommodating rotation of a control key in the key passage from said first key position to either said second interlock position or said third interlock position, and shoulder means positioned to allow movement of the operator's key from said first key position to said second key position but barring movement of the operator's key from said first key position to said third key position.

15. A changeable key cylinder padlock as defined in claim 8 wherein said bottom wall portion of said padlock casing adjacent said key passage for said cavity has means for accommodating rotation of a control key in the key passage from said first key position to either said second interlock position or said third interlock position, and shoulder means positioned to allow movement of the operator's key from said first key position to said second key position but barring movement of the operator's key from said first key position to said third key position.

* * * * *